US008562085B2

(12) United States Patent
Chen et al.

(10) Patent No.: US 8,562,085 B2
(45) Date of Patent: Oct. 22, 2013

(54) INSTALLATION DEVICE FOR SLIDE ASSEMBLY

(75) Inventors: Ken-Ching Chen, Kaohsiung (TW); Chien-Li Huang, Kaohsiung (TW); Chun-Chiang Wang, Kaohsiung (TW)

(73) Assignees: King Slide Works Co. Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 254 days.

(21) Appl. No.: 13/204,747

(22) Filed: Aug. 8, 2011

(65) Prior Publication Data

US 2013/0039608 A1 Feb. 14, 2013

(51) Int. Cl.
*A47B 88/04* (2006.01)

(52) U.S. Cl.
USPC ..... 312/333; 312/334.46

(58) Field of Classification Search
USPC ..... 312/330.1, 333, 334.1, 334.7, 334.8, 312/334.11, 334.44, 334.46, 334.47; 211/26; 384/21, 22; 361/825
See application file for complete search history.

(56) References Cited

U.S. PATENT DOCUMENTS

| | | | | |
|---|---|---|---|---|
| 6,209,979 | B1 | 4/2001 | Fall et al. | |
| 6,373,707 | B1 * | 4/2002 | Hutchins | 361/725 |
| 6,588,866 | B2 | 7/2003 | Cheng | |
| 6,601,933 | B1 * | 8/2003 | Greenwald | 312/333 |
| 6,938,967 | B2 | 9/2005 | Dubon et al. | |
| 6,948,691 | B2 | 9/2005 | Brock et al. | |
| 7,604,307 | B2 | 10/2009 | Greenwald et al. | |
| 7,850,369 | B2 | 12/2010 | Young et al. | |
| 7,871,139 | B2 | 1/2011 | Yu et al. | |
| 2007/0018547 | A1 * | 1/2007 | Yang et al. | 312/333 |
| 2007/0114895 | A1 * | 5/2007 | Chen et al. | 312/333 |
| 2009/0218469 | A1 * | 9/2009 | Yu et al. | 248/430 |

* cited by examiner

*Primary Examiner* — James O Hansen
(74) *Attorney, Agent, or Firm* — Rosenberg, Klein & Lee

(57) ABSTRACT

An installation device includes a retaining member fixed to a rail of the slide assembly and including a base, a release portion, an arm and a resilient portion. The base contacts the first contact portion of the rail. The release portion extends from the base. The arm has a retaining hole and a positioning portion. The retaining hole is located corresponding to an installation hole of the rail, and the positioning portion contacts the second contact portion of the rail. The resilient portion is connected to the rail so as to provide a resilient force to keep the retaining hole of the arm facing the installation hole of the rail. When a force is applied to the release portion, the arm is moved and the positioning portion is disengaged from the second contact portion, so that the installation member is released from the installation hole of the rail.

7 Claims, 5 Drawing Sheets

INSTALLATION DEVICE FOR SLIDE ASSEMBLY

FIELD OF THE INVENTION

The present invention relates to an installation device for a slide assembly, and more particularly to a retaining member which is engaged with an installation member of an exterior equipment and the installation member can be easily released.

BACKGROUND OF THE INVENTION

A conventional installation device for a slide assembly is disclosed in U.S. Pat. No. 6,938,967, with the title of "Telescoping slide assembly" to Dubon and generally includes a chassis 12, multiple mounting posts 14 connected to two sides of the chassis, a telescoping slide assembly 10, and a post-locking latch 66, wherein the mounting slide elements 24 of the slide assembly has multiple slots 16 and the post-locking latch is installed to the mounting slide element and a part of the post-locking latch extends into one of the slots. When in assembling, each mounting post is inserted in each slot and one of the mounting posts is positioned by the post-locking latch. By this arrangement, the chassis is securely connected to the mounting slide elements.

However, when the two sides of the chassis are connected to a rack by two rails, the chassis may impact the post-locking latch when the chassis is moved relative to the slide assembly or vibration from the operation site. If the post-locking latch is not strong enough to bear the impact, the post-locking latch is easily damaged.

The present invention intends to provide an installation device for a slide assembly to improve the shortcoming mentioned above.

SUMMARY OF THE INVENTION

The present invention relates to an installation device for a slide assembly and comprises a first rail, a second rail and a retaining member. The second rail is longitudinally movable relative to the first rail and has an opening, a first contact portion, a second contact portion and multiple holes including at least a first installation hole and a second installation hole. The first contact portion extends from an inner wall of the opening. The first installation hole is located between the opening and the second contact portion. The retaining member has a base contacting the first contact portion of the second rail, a release portion extending from the base, a bent portion extending from the release portion and connected with an arm and a resilient portion. The arm contacts the second rail so that the release portion is located away from the second rail. The arm extends from the bent portion and beyond the first installation hole of the second rail. The arm has a retaining hole and a positioning portion, wherein the retaining hole is located corresponding to the first installation hole of the second rail, and the positioning portion is located corresponding to the second contact portion of the second rail. The resilient portion extends from the arm and toward the release portion. The resilient portion connected to the second rail and provides a resilient force to keep the retaining hole of the arm facing the first installation hole of the second rail.

The first installation hole of the second rail is engaged with a first installation member of an exterior apparatus. The second installation hole of the second rail is engaged with a second installation member of the exterior equipment. The retaining hole of the arm of the retaining member accommodates the first installation member. The positioning portion of the arm contacts the second contact portion of the second rail. The first installation member is located in the first installation hole by the retaining member.

When a force is applied to the release portion, the arm of the retaining member is moved relative to the second rail and the positioning portion of the retaining member is disengaged from the second contact portion of the second rail, so that the first installation member is released from the first installation hole of the second rail and the retaining hole of the retaining member.

Preferably, the base of the retaining member has a notch which is located corresponding to the first contact portion of the second rail.

Preferably, the arm of the retaining member has two wings respectively on two sides thereof.

Preferably, the first contact protrusion of the second rail is an L-shaped protrusion.

Preferably, the second contact portion of the second rail is a hole and the positioning portion of the retaining member is inserted into the hole.

Preferably, the retaining hole of the retaining member has a stop protruding from the inside thereof and the stop is located above the first installation hole of the second rail.

Preferably, the second installation hole has a protrusion extending from an inner wall thereof.

The primary object of the present invention is to provide an installation device wherein the retaining member is easily engaged with or disengaged from the installation member of an exterior apparatus. The retaining member is fixed to the second rail by riveting which is less expensive and easy.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
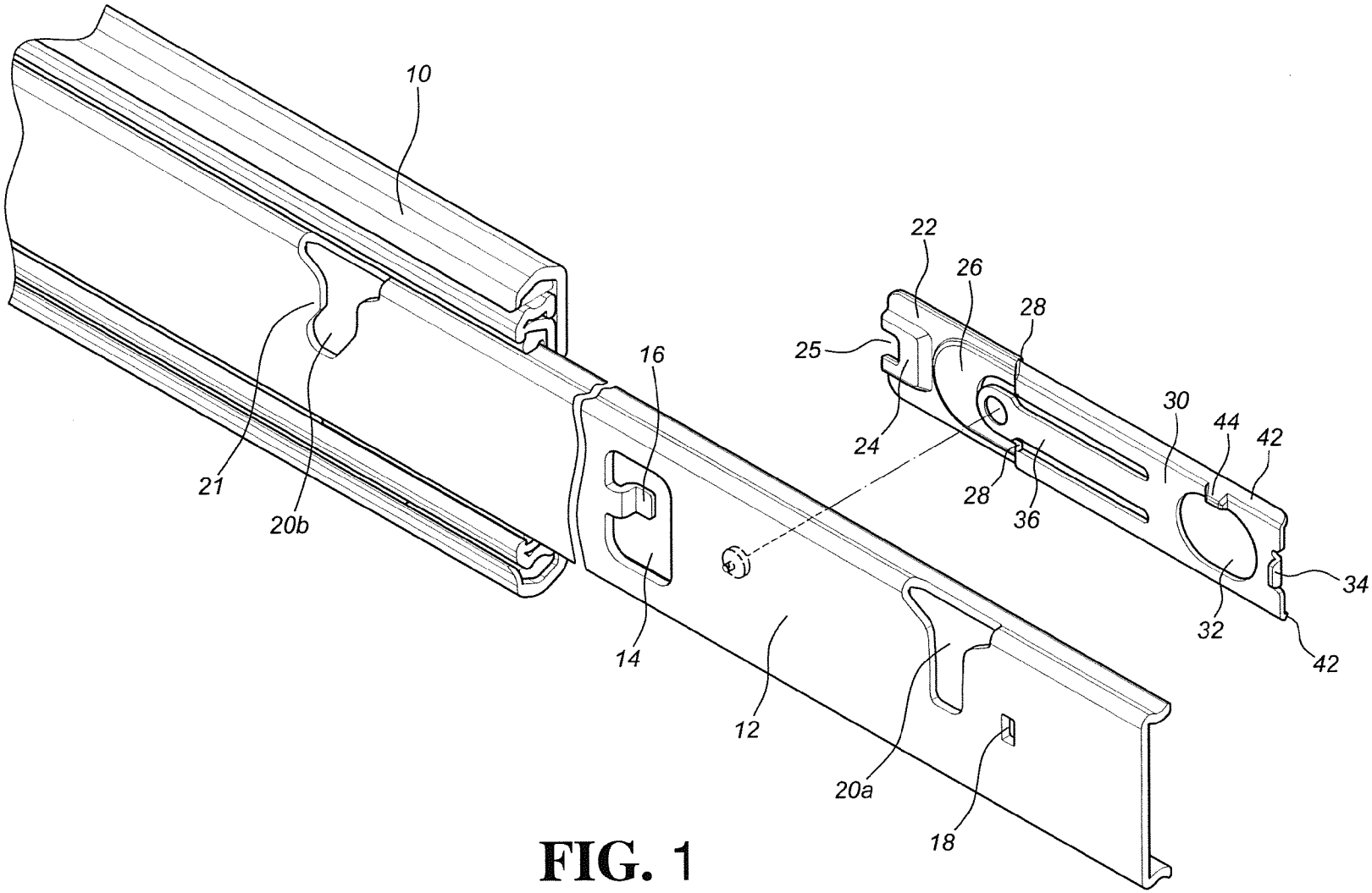
FIG. 1 is an exploded view to show the installation device of the present invention.
Figure 2:
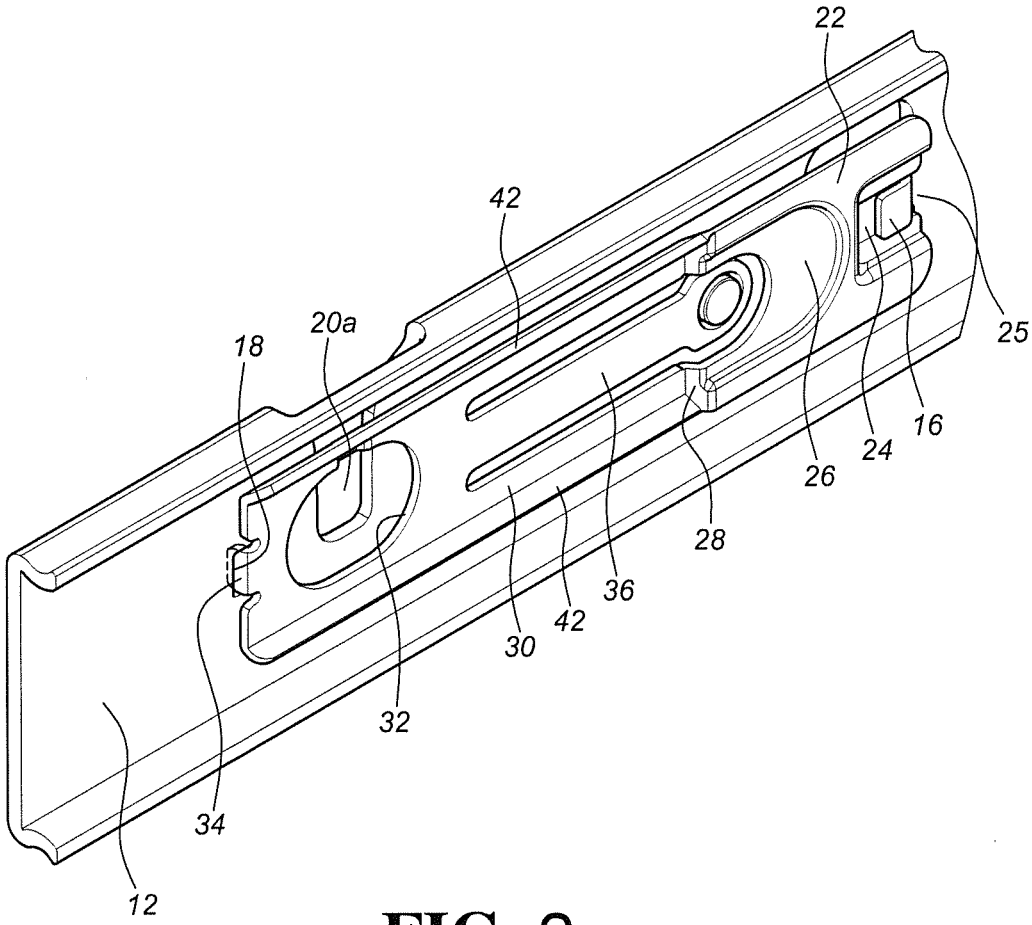
FIG. 2 is a perspective view to show the installation device of the present invention.

Referring to FIGS. 1 and 2, the installation device of a slide assembly of the present invention comprises a first rail 10 and a second rail 12 which is longitudinally movable relative to the first rail 10. The second rail 12 has an opening 14, a first contact portion 16, a second contact portion 18 and multiple holes including at least a first installation hole 20*a* and a second installation hole 20*b*. The first contact portion 16 extends from an inner wall of the opening 14 and is an L-shaped protrusion. The second contact portion 18 of the second rail 12 is a hole. The first installation hole 20*a* is located between the opening 14 and the second contact portion 18. The second installation hole 20*b* is located at a distance from the first installation hole 20*a*. The second installation hole 20*b* has a protrusion 21 extending from an inner wall thereof.

A retaining member 22 has a base 24 contacting the first contact portion 16 of the second rail 12 and the base 24 of the retaining member 22 has a notch 25 which is located corresponding to the first contact portion 16 of the second rail 12. A release portion 26 extends from the base 24. A bent portion 28 extends from the release portion 26 and is connected with an arm 30. As shown in FIG. 2, a part of the bent portion 28 and the arm 30 contact the second rail 12 so that the release portion 26 is located away from the second rail 12.

The arm 30 extends from the bent portion 28 and beyond the first installation hole 20*a* of the second rail 12. The arm 30 has a retaining hole 32 and a positioning portion 34. The retaining hole 32 is located corresponding to the first installation hole 20*a* of the second rail 12, and the positioning portion 34 is located corresponding to the second contact portion 18 of the second rail 12.

A resilient portion 36 extends from the arm 30 and toward the release portion 26. The resilient portion 36 is connected to the second rail 12 by rivets and provides a resilient force to keep the retaining hole 32 of the arm 30 facing the first installation hole 20*a* of the second rail 12.

The arm 30 of the retaining member 22 has two wings 42 respectively on two sides thereof so as to reinforce the structure of the arm 30 to avoid from bending.

The retaining hole 32 of the retaining member 22 has a stop 44 protruding from the inside thereof and the stop 44 is located above the first installation hole 20*a* of the second rail 12.

Figure 3:
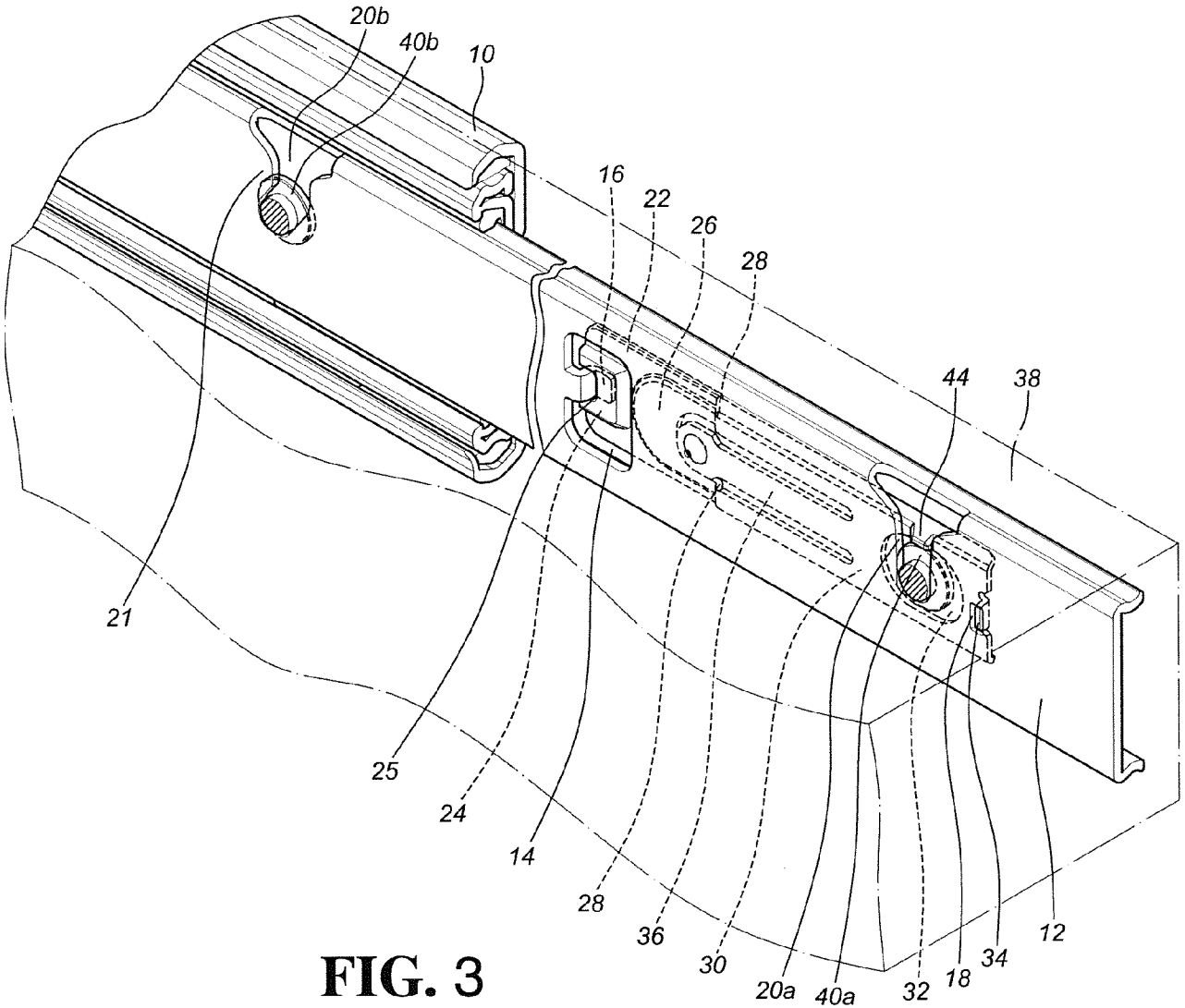
FIG. 3 is a perspective view to show an exterior equipment is connected to the rail of the installation device of the present invention.
Figure 4:
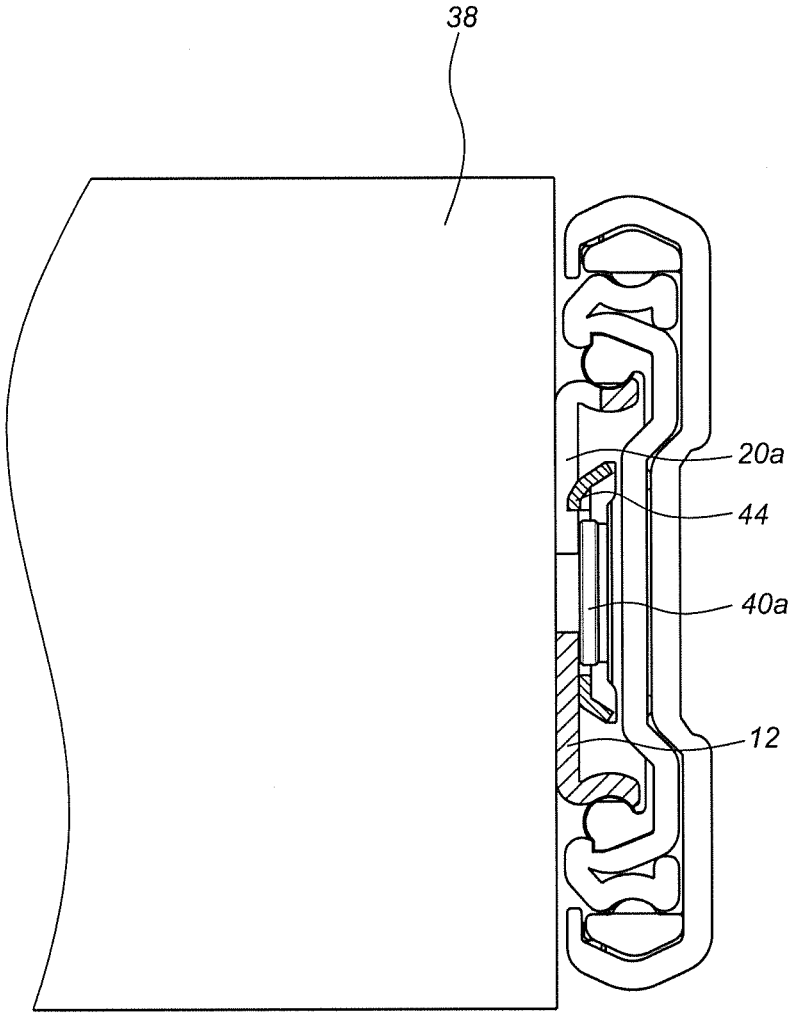
FIG. 4 is a partial view to show the exterior equipment is connected to the rail of the installation device of the present invention.

As shown in FIGS. 3 and 4, the sequence of installation, preferably, the second installation member 40*b* of the exterior equipment 38 is first engaged with the second installation hole 20*b* of the second rail 12, and then the first installation member 40*a* of the exterior equipment 38 is engaged with the first installation hole 20*a* of the second rail 12. Therefore, when the first installation member 40*a* of the exterior equipment 38 is positioned in the first installation hole 20*a* of the second rail 12, the second installation member 40*b* of the exterior equipment 38 is engaged with the second installation hole 20*b* of the second rail 12 and stopped by the protrusion 21 to avoid the second installation member 40*b* of the exterior equipment 38 from protruding upward from the second installation hole 20*b*, so that the exterior equipment 38 is ensured to be connected to the second rail 12. In this embodiment, the retaining hole 32 of the retaining member 22 accommodates the first installation member 40*a*, and the positioning portion 34 of the retaining member 22 contacts the second contact portion 18 of the second rail 12. By this way, the retaining member 22 and the second rail 12 are connected to each other stably. The first installation member 40*a* is mounted by the retaining hole 32 of the retaining member 22, so that the first installation member 40*a* is located in the first installation hole 20*a* by the retaining member 22 and cannot disengage from the second rail 12. The stop 44 of the retaining hole 32 of the retaining member 22 may contact the top of the first installation member 40*a* to reinforce the contact.

Figure 5:
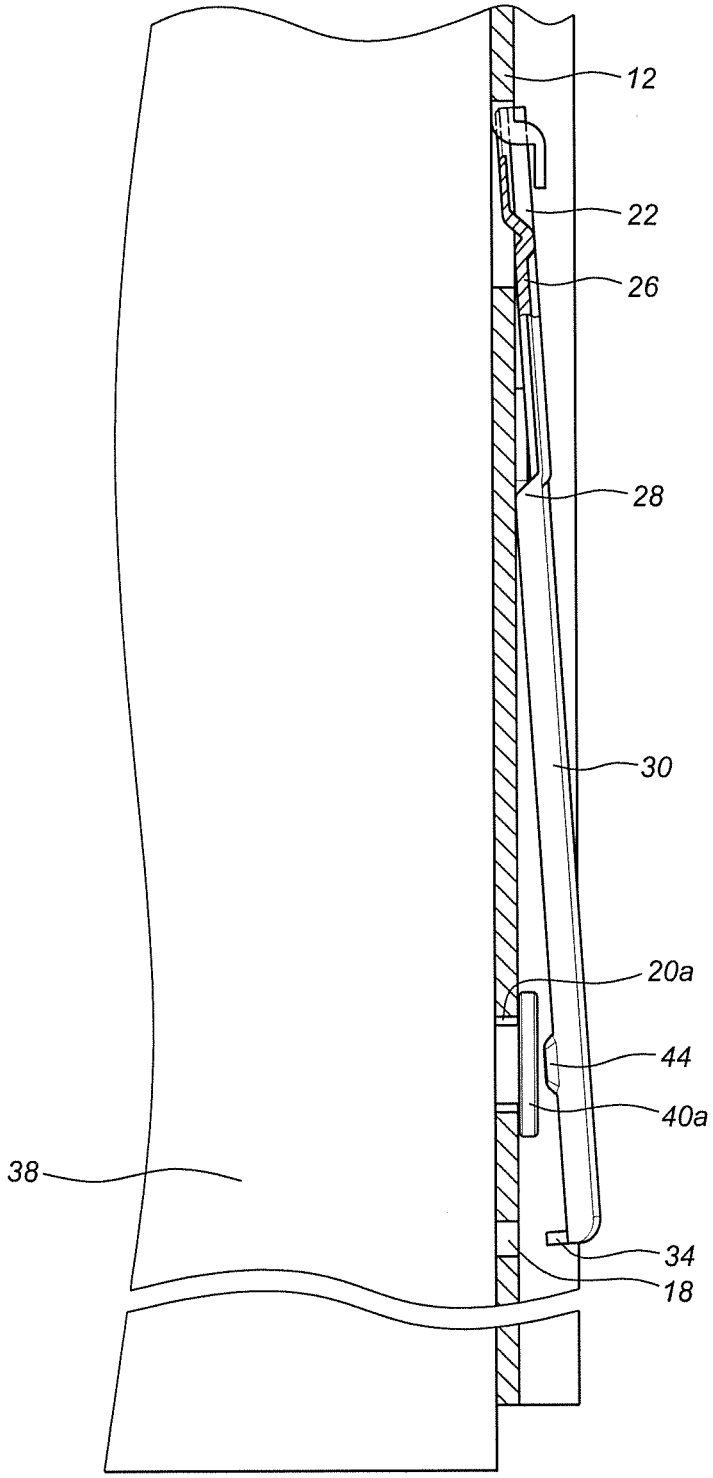
FIG. 5 shows that the installation device of the present invention is in released status.

As shown in FIG. 5, when a force is applied to the release portion 26, the bent portion 28 of the retaining member 22 is against the second rail 12 to function as a fulcrum, so that the arm 30 on the other side of the contact point may move away relative to the second rail 12. The positioning portion 34 of the retaining member 22 is disengaged from the second contact portion 18 of the second rail 12, so that the first installation member 40*a* is released from the retaining hole 32 of the retaining member 22. The first installation member 40*a* is released upward from the first installation hole 20*a* of the second rail 12 and does not interfere the stop 44. After the first installation member 40*a* of the exterior equipment 38 is released upward from the first installation hole 20*a* of the second rail 12, the second installation member 40*b* can be released upward from the second installation hole 20*b* of the second rail 12 by the inclined exterior equipment 38 and without interference with the protrusion 21 in the second installation hole 20*b*.

While we have shown and described the embodiment in accordance with the present invention, it should be clear to those skilled in the art that further embodiments may be made without departing from the scope of the present invention.

What is claimed is:

1. An installation device for a slide assembly, comprising:

a first rail;

a second rail longitudinally movable relative to the first rail, the second rail having an opening, a first contact portion, a second contact portion and multiple holes including at least a first installation hole and a second installation hole, the first contact portion extending from an inner wall of the opening, the first installation hole located between the opening and the second contact portion;

a retaining member having a base contacting the first contact portion of the second rail, a release portion extending from the base, a bent portion extending from the release portion and connected with an arm, the arm contacting the second rail so that the release portion is located away from the second rail;

the arm extending from the bent portion and beyond the first installation hole of the second rail, the arm having a retaining hole and a positioning portion, the retaining hole located corresponding to the first installation hole of the second rail, the positioning portion located corresponding to the second contact portion of the second rail;

a resilient portion extending from the arm and toward the release portion, the resilient portion connected to the second rail and providing a resilient force to keep the retaining hole of the arm facing the first installation hole of the second rail;

the first installation hole of the second rail engaged with a first installation member of an exterior equipment, the second installation hole of the second rail engaged with a second installation member of the exterior equipment, the retaining hole of the arm of the retaining member accommodating the first installation member, the positioning portion of the arm contacting the second contact portion of the second rail, the first installation member located in the first installation hole by the retaining member;

when a force is applied to the release portion, the arm of the retaining member being moved relative to the second rail and the positioning portion of the retaining member is disengaged from the second contact portion of the second rail, so that the first installation member is released from the first installation hole of the second rail and the retaining hole of the retaining member.

2. The installation device as claimed in claim 1, wherein the base of the retaining member has a notch which is located corresponding to the first contact portion of the second rail.

3. The installation device as claimed in claim 1, wherein the arm of the retaining member has two wings respectively on two sides thereof.

4. The installation device as claimed in claim 1, wherein the first contact protrusion of the second rail is an L-shaped protrusion.

5. The installation device as claimed in claim 1, wherein the second contact portion of the second rail is a hole and the positioning portion of the retaining member is inserted into the hole.

6. The installation device as claimed in claim 1, wherein the retaining hole of the retaining member has a stop protruding from an inside thereof and the stop is located above the first installation hole of the second rail.

7. The installation device as claimed in claim 1, wherein the second installation hole has a protrusion extending from an inner wall thereof.

* * * * *